US007326102B2

(12) United States Patent
Fujii et al.

(10) Patent No.: US 7,326,102 B2
(45) Date of Patent: Feb. 5, 2008

(54) APPARATUS FOR LAPPING THIN FILM MAGNETIC HEADS

(75) Inventors: Ryuji Fujii, Kwai Chung (HK); Hiroki Matsukuma, Tokyo (JP)

(73) Assignees: SAE Magnetics (H.K.) Ltd., Kwai Chung (HK); TDK Corporation, Tokyo (JP)

( * ) Notice: Subject to any disclaimer, the term of this patent is extended or adjusted under 35 U.S.C. 154(b) by 338 days.

(21) Appl. No.: 10/938,578

(22) Filed: Sep. 13, 2004

(65) Prior Publication Data

US 2005/0095956 A1 May 5, 2005

(30) Foreign Application Priority Data

Oct. 29, 2003 (JP) ..... 2003-369205

(51) Int. Cl.
*B24B 49/00* (2006.01)
*B24B 51/00* (2006.01)
*B24B 9/00* (2006.01)

(52) U.S. Cl. ..... 451/8; 29/603.16; 451/278

(58) Field of Classification Search ..... 451/5, 451/8, 10, 41, 59, 278, 279, 364; 29/603.12, 29/603.15, 603.16

See application file for complete search history.

(56) References Cited

U.S. PATENT DOCUMENTS 5,721,488 A * 2/1998 Sakai et al. ..... 324/210
5,951,371 A * 9/1999 Hao ..... 451/28
6,196,897 B1 * 3/2001 Suto et al. ..... 451/8
6,212,033 B1 * 4/2001 Sasaki ..... 360/230
6,238,276 B1 5/2001 Miyazaki et al.
6,276,991 B1 * 8/2001 Kobayashi et al. ..... 451/28
6,497,611 B2 * 12/2002 Sakurada et al. ..... 451/5
6,722,947 B2 * 4/2004 Nishioka et al. ..... 451/10
6,807,722 B2 * 10/2004 Sasaki et al. ..... 29/603.09
6,881,124 B2 * 4/2005 Takahashi et al. ..... 451/5
6,905,394 B2 * 6/2005 Sudo et al. ..... 451/24
6,913,509 B2 * 7/2005 Sone et al. ..... 451/5
7,014,532 B2 * 3/2006 Nishioka et al. ..... 451/10

FOREIGN PATENT DOCUMENTS

JP 10-286765 10/1998
JP 2000-153451 6/2000
JP 2001-6128 1/2001
JP 2003-091804 3/2003

* cited by examiner

*Primary Examiner*—Timothy V. Eley
(74) *Attorney, Agent, or Firm*—Oblon, Spivak, McClelland, Maier & Neustadt, P.C.

(57) ABSTRACT

A lapping method and apparatus is provided that increases the yield rate in the magnetic head slider manufacturing process. According to the invention, an apparatus for lapping thin film magnetic heads includes a jig block and a lapping plate. The jig block includes a first jig which holds a bar to be lapped, and second jig which holds a member for load sharing. The lapping plate is movable relative to the first jig and the second jig, and is contactable with the surface to be lapped of the bar held by the first jig and the member for load sharing held by the second jig for lapping.

5 Claims, 11 Drawing Sheets

APPARATUS FOR LAPPING THIN FILM MAGNETIC HEADS

PRIORITY CLAIM

This application claims priority from Japanese patent application No. 2003-369205, filed on Oct. 29, 2003, which is incorporated herein by reference.

BACKGROUND OF THE INVENTION

1. Field of the Invention

The present invention relates to a lapping apparatus and method used in the lapping process for the manufacture of thin film magnetic heads.

2. Description of the Related Art

A magnetic head slider used in a magnetic disc provides at least one thin film head element, which is located at a trailing edge (exhaust side of the air flow) of the magnetic head slider, and a magnetic head slider is provided such that such floats above the surface of the magnetic disc by rotating the magnetic disc.

In the manufacturing process, a plural of magnetic head elements are formed on a wafer (substrate), and the wafer is cut into a plurality of bars, which have a plurality of magnetic head elements in line, and then lapping of the air bearing surface (ABS) of a bar is performed, wherein the air bearing surface comprises the surface which faces the surface of the magnetic disc.

FIGS. 1*a* and 1*b* are a plane view of a holding jig, which is used in a lapping method according to the prior art, showing from a lapping plate side.

For the lapping method according to the prior art, as shown in FIGS. 1*a* and 1*b*, a triangle shaped holding jig 10 or a square shaped holding jig 11 which can rotate themselves around a supporting point 10*a* or 11*b* is used. More specifically, three bars 12 or four bars 13 to be lapped are fixed on the plane 10*b* or 11*b* of the holding jig, whereby the plane 10*b* and 11*b* face the lapping plate, and the surface to be ABS of the bars 12 or 13 are lapped by rotating the holding jig 10 or 11 around the supporting point 10*a* or 11*b* as well as rotating the lapping plate.

This method makes it possible to practice lapping a plurality of bars at the same time and, therefore, the efficiency of lapping increases, machining time can be shortened, and the stress applied to each of the bars spreads. However, since amount of lapping (amount of height) is controlled by the lapping time, it is not possible to change the amount of lapping by each bar to be lapped at the same time, and therefore it causes the serious problem that the characteristics of the magnetic head slider to be manufactured vary widely.

To solve the above-mentioned problem, according to the prior art, JP laid open 2001-6128 propose a method for lapping control, which is referred as resistance lapping guide (RLG), by measuring the value of resistance of sensors which are formed on the bar.

However, for the lapping by RLG method, it is required to lap only one bar fixed on one holding jig, which is mounted on one lapping apparatus, based on its principle of operation.

Therefore following problems are caused by use of RLG method.

(1) As the thin film magnetic head advances, the required characteristics become more severe, so that in the magnetic head slider manufacturing process, the yield rate is decreasing, because a lot of magnetic head sliders are rejected in the quasi static test (QST), especially rejected by bad output and asymmetry characteristics. It decreases the yield rate in the head gimbal assembly (HGA) process, in which the magnetic head sliders are attached to suspension arms.

(2) Similarly, since it is required for ABS surface to finish with high accuracy, processing becomes more difficult. Therefore profile about the finished surface of the magnetic head slider, for example recess or crown profile has varied widely. Wide variability of the profile causes the instability of magnetic spacing, such as the height thereof when airborne, to increase the variation of electromagnetic conversion transfer characteristic in the HGA process. Therefore such leads to decreasing of the yield rate in the HGA process.

BRIEF SUMMARY OF THE INVENTION

The invention has been made in view of the above-mentioned problem, and it is therefore an object of the present invention to provide a lapping method and apparatus that increases the yield rate in the magnetic head slider manufacturing process, but does not make output and asymmetry characteristics bad.

Another object of the present invention is to provide a lapping method and apparatus that reducing the variation of the profile of magnetic head sliders.

According to the present invention, an apparatus for lapping thin film magnetic heads including a jig block having a first jig and at least one second jig, the first jig holding a bar having a plurality of thin film magnetic heads in lines, the second jig holding a member for load sharing, and a lapping plate being movable relative to the first jig and the second jig, and being contactable with the surface to be lapped of the bar held by the first jig and the member for load sharing held by the second jig for lapping.

According to the another aspect of the invention, a method for lapping thin film magnetic heads which comprises the step of: holding a bar to contact with a lapping plate by use of a holding jig block, the bar having a plural of thin film magnetic heads in lines, holding at least one member for load sharing to contact with the lapping plate by use of the holding jig; and lapping a surface of the bar by moving the lapping plate relative to the bar.

As mentioned above, it is required to lap only one bar fixed on one holding jig, which is mounted on one lapping apparatus, when the lapping is performed by use of the RLG method. Therefore such applies a strong load or stress to the bar. The study of inventors of this application shows that bad characteristic of the output and/or asymmetry in the manufacturing process and big variation of between profiles are caused by the load or stress applied to the bar during the lapping operation. Therefore to reduce the load applied to the bar, such as the machine load, drag from the lapping plate and frictional force with the lapping plate, at least one member for load sharing, which is lapped together with the bar, is provided to distribute the load or stress. As a result, both playback output and asymmetry characteristic are improved. Also the defect occurring on the surface of the lapping plate and the magnetic head slider, such as scratches and abrasions are reduced, and variation between profiles as well as amount of recess are reduced. Therefore, the yield rate is significantly improved in the manufacturing process of the magnetic head sliders and HGA.

Favorably, the second jig lies anterior to the first jig on the basis of the relative move direction of the lapping plate, so that means the for load sharing lies anterior to the bar.

Preferably, the second jig or the member is attached to the jig block with the fixed or variable angle relative to move direction of the lapping plate.

Advantageously, the lapping operation for the bar is controlled by the signal from a sensor, which is formed in the bar, such as RLG.

Further objects and advantages of the present invention will be apparent from the following description of the preferred embodiments of the invention as illustrated in the accompanying drawings.

DETAILED DESCRIPTION OF THE INVENTION

Figure 1A:
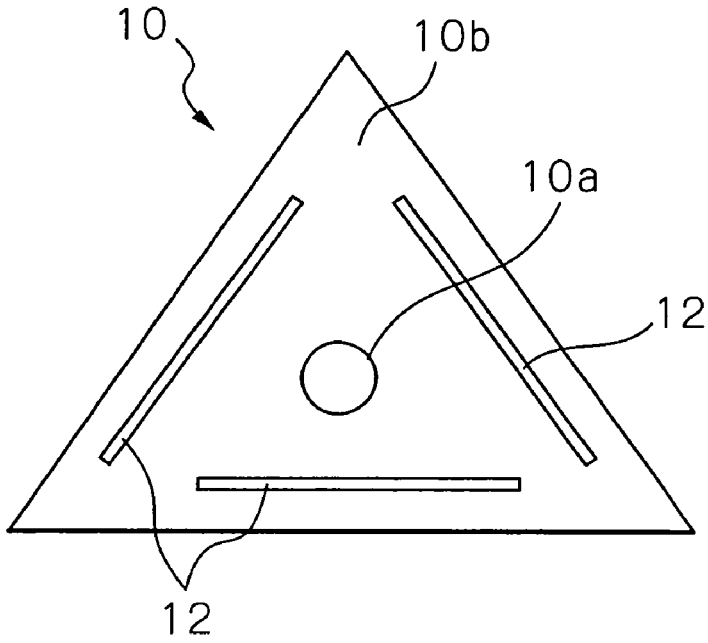
Fig. 1a PRIOR ART
FIG. 1*a*, already described, is a plan view of a holding jig, which is used in a lapping method according to the prior art, showing from a lapping plate.
Figure 1B:
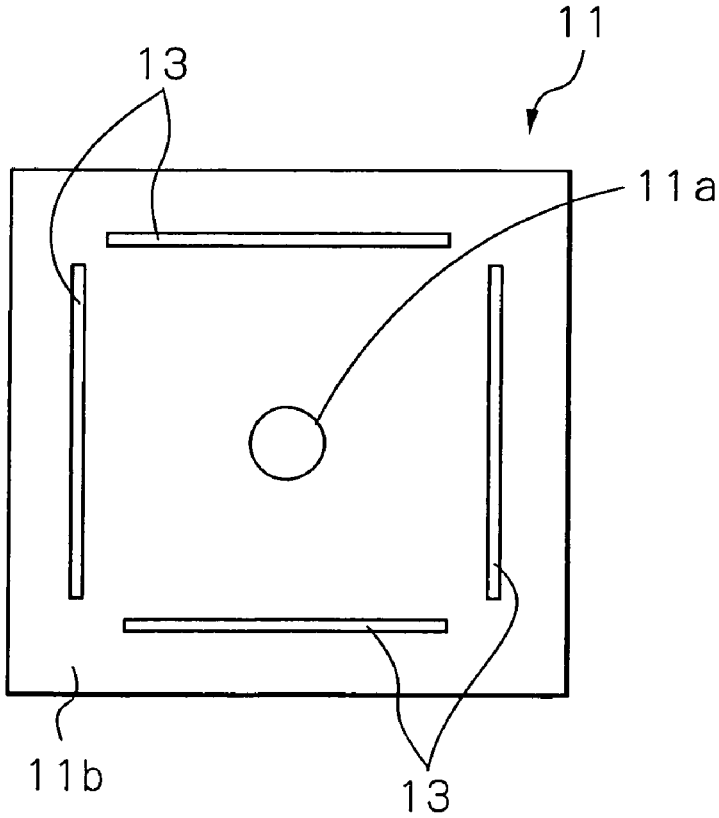
Fig. 1b PRIOR ART
FIG. 1*b*, already described, is a plan view of a holding jig, which is used in a lapping method according to the prior art, showing from a lapping plate.
Figure 2:
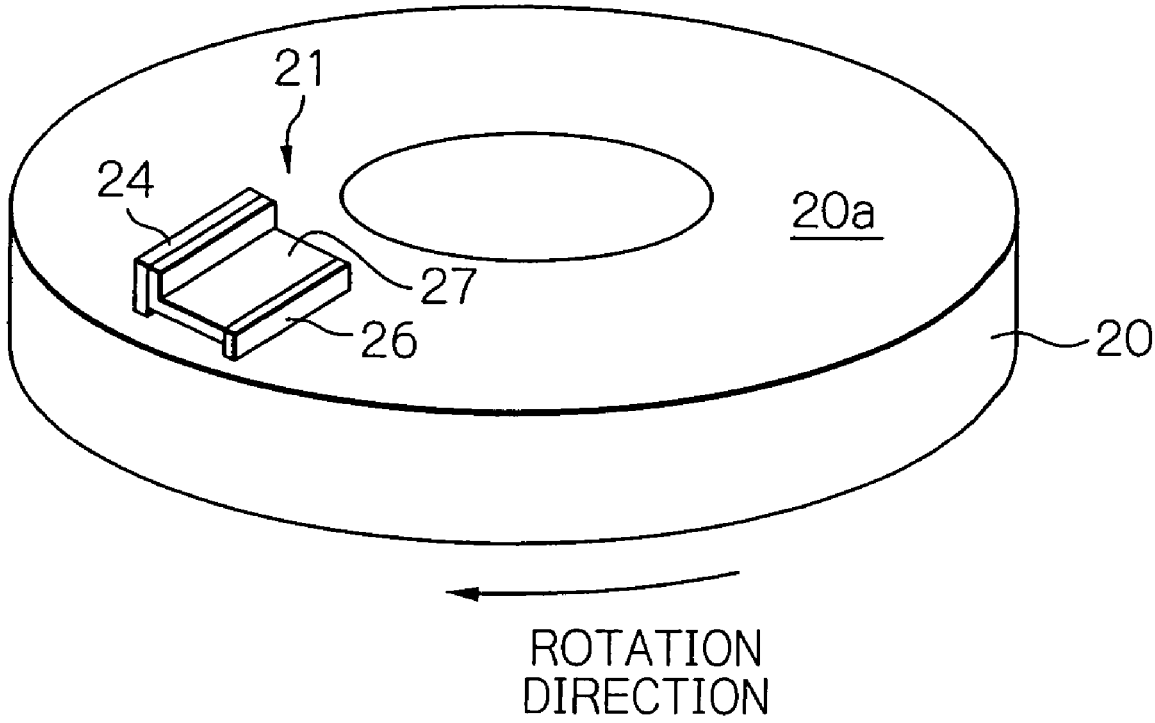
FIG. 2 is a perspective view showing an embodiment of a lapping apparatus schematically according to the present invention.
Figure 3:
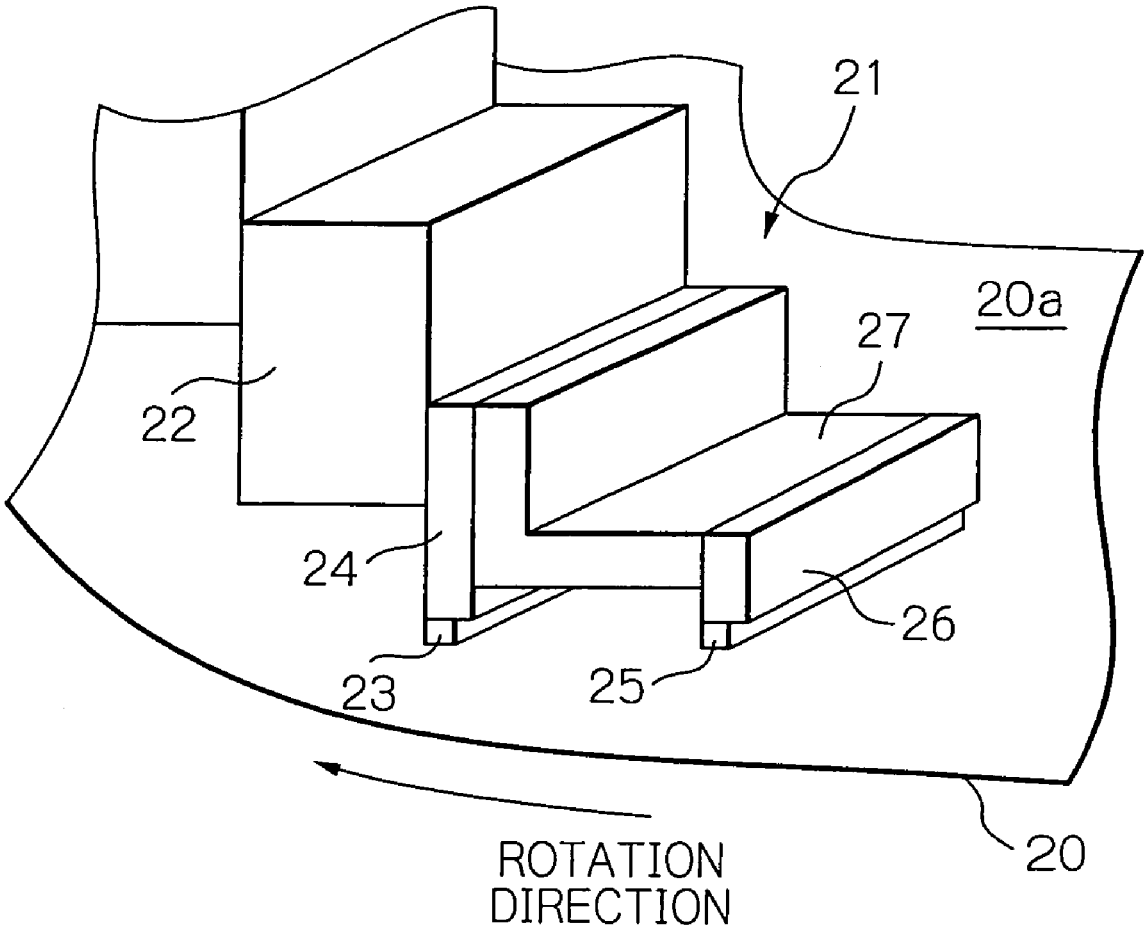
FIG. 3 is an enlarged perspective view of the lapping apparatus shown in FIG. 2, for showing the detail of the holding jig block.

FIG. 2 is a perspective view showing an embodiment of a lapping apparatus schematically according to the present invention, and FIG. 3 is an enlarged perspective view of the lapping apparatus shown in FIG. 2, for showing the detail of the holding jig block.

In the FIG. 2 and FIG. 3, reference 20 is a lapping plate, which rotates the direction indicated by the arrow, and reference 21 is a holding jig block or assembly, whereby a holding jig in the holding jig block 21 holds the bar to be lapped, and reference 22 is a transfer tool, which supports the holding jig in the holding jig block 21, and provides the signal line to transmit the signal from a lapping amount sensor, which is described later, to controller of the lapping apparatus.

The holding jig block 21 mainly includes a rectangular column shaped jig 24 (a first jig), which holds a bar 23 to be lapped, and a dummy bar jig 26 (a second jig), which holds a dummy bar 25, and a lapping keeper 27, which is fixed to the dummy bar jig 26 at one end, and fixed to the rectangular column shaped jig 24 at other end. The dummy bar 25 is favorably made of the same material as the bar 23, such as AlTiC ($Al_2O_3$—TiC).

Figure 4:
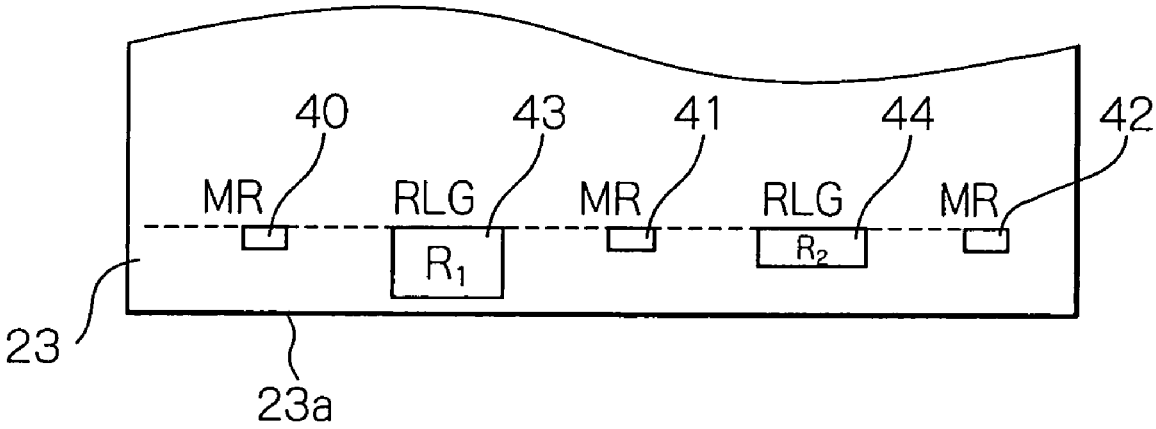
FIG. 4 is a plane view illustrating RLG sensors formed on the bar.

The bar 23 has a plurality of thin film magnetic heads, which are arranged in one line or in several lines, and is obtained by cutting the wafer, on which a plurality of thin film magnetic heads are formed. By way of example, mageto-resistive films 40, 41 and 42 of the thin film magnetic head are formed on the side of ABS (surface to be lapped) 23*a* of the bar 23 as shown in FIG. 4, and arranged in line, and MR films 43 and 44 of RLG sensor (hereinafter referred to as RLG sensors for short), which is a sensor for detecting the amount of lapping, are respectively formed between MR films of the thin film head.

MR height is calculated based on the value of resistance of the RLG sensor 43 and 44, whereby the value of resistance changes dynamically during the lapping, and lapping operation is controlled. The method for calculating the MR height from the value of resistance of the RLG sensor is well known, therefore, a detailed description thereof is omitted. (See JP laid open 2003-91804 for more detail)

In the embodiment, the dummy bar jig 26 lies anterior to the rectangular column shaped jig 24 on the basis of the rotation direction, so that means the dummy bar 25 lies anterior to the bar 23.

The lapping is performed by pressing the lapped surface of the bar 23 to a lapping surface 20*a* of the rotating lapping plate 20. In this case, both the bar 23 and the dummy bar 25 are pressed to the lapping plate, so that the load during the lapping, for example machine load, drag from the lapping plate and frictional force with the lapping plate, is not concentrated to the bar 23, but is instead distributed to two points. Therefore, output and asymmetry characteristic of the magnetic head slider are improved, thus avoiding defects occurring on the surface of the lapping plate and the slider such as scratches or abrasions, and such reduces the variation between profiles, and reduces the variation between amount of recess of the magnetic head slider. As a result, the yield rate is significantly improved in the manufacturing process of the magnetic head sliders and HGA.

Figure 5:
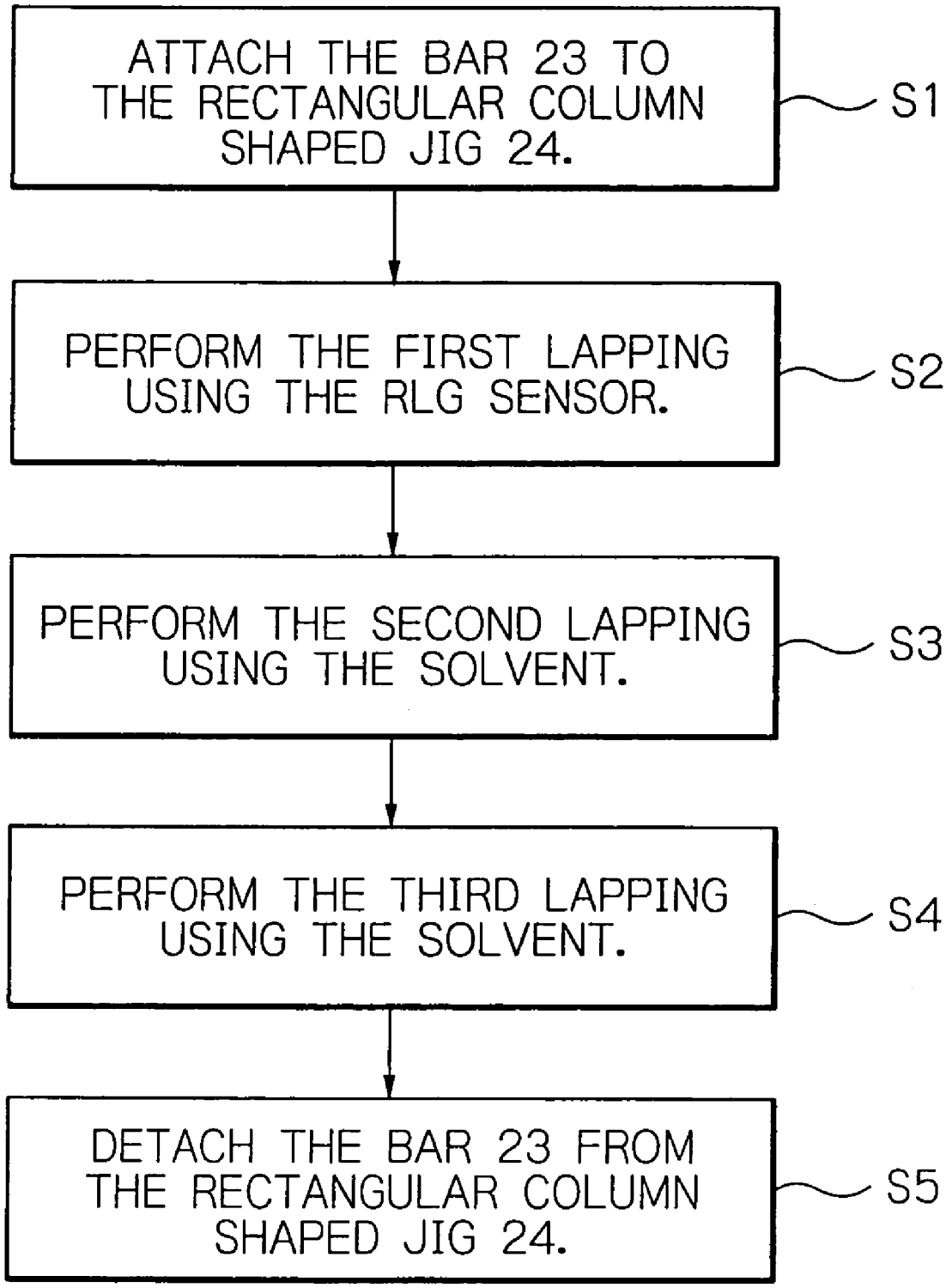
FIG. 5 is an example of flow diagram used in the lapping process.

FIG. 5 is an example of flow diagram used in the lapping process

First, the bar 23 is attached to the rectangular column shaped jig 24 (Step S1). The ABS (Surface to be lapped) should face the lapping plate 20, and the training edge (exhaust side of the air flow) should be the backside based on the rotation direction of the lapping plate 20.

Next a first lapping is performed using RIG sensors (Step S2). The purpose of the first lapping is to adjust the MR height of the bar for desired height. The conditions for the same, for example, include utilizing grain diameter of the slurry is about 1/10 um, and using a lapping time of about 10 to 20 minutes, the stress being about 1.0 to 2.0 kgf, and the rotational speed of the lapping plate being about 10 to 60 rpm.

Next a second lapping is performed using solvent (step S3). The purpose of the second lapping is to complete the adjusting the MR height. The conditions for the same, for example, include using a diamond slurry and oil solvent, a grain diameter of the slurry being about 1/8 um, the lapping time being about 3 to 7 minutes, the stress being about 1.5 to 2.3 kgf, and the rotation-speed of the lapping plate being about 2 to 4 rpm.

Then a third lapping is performed using solvent (step S4). The purpose of the third lapping is for mirror finishing. The condition for such, for example, include using diamond slurry and oil solvent, a grain diameter of the slurry being about 1/10 um the lapping time being about 1 to 3 minutes, the stress being about 3.5 to 4.5 kgf, and the rotation speed of the lapping plate being about 2 to 3 rpm.

Next the lapped bar 23 is detached from the rectangular column shaped jig 24 (Step S5).

Then rails are formed on the ABS of bar 23 (not shown in FIG. 5), cut the bar 23 into a plural of single magnetic head slider. Finally, the magnetic head slider is mounted on a suspension to complete the HGA.

Figure 6A:
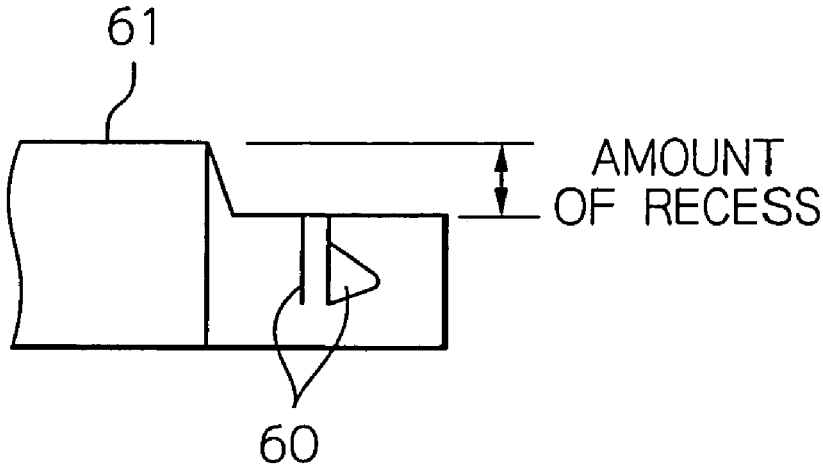
FIG. 6*a* illustrates the amount of recess to be measured.
Figure 6B:
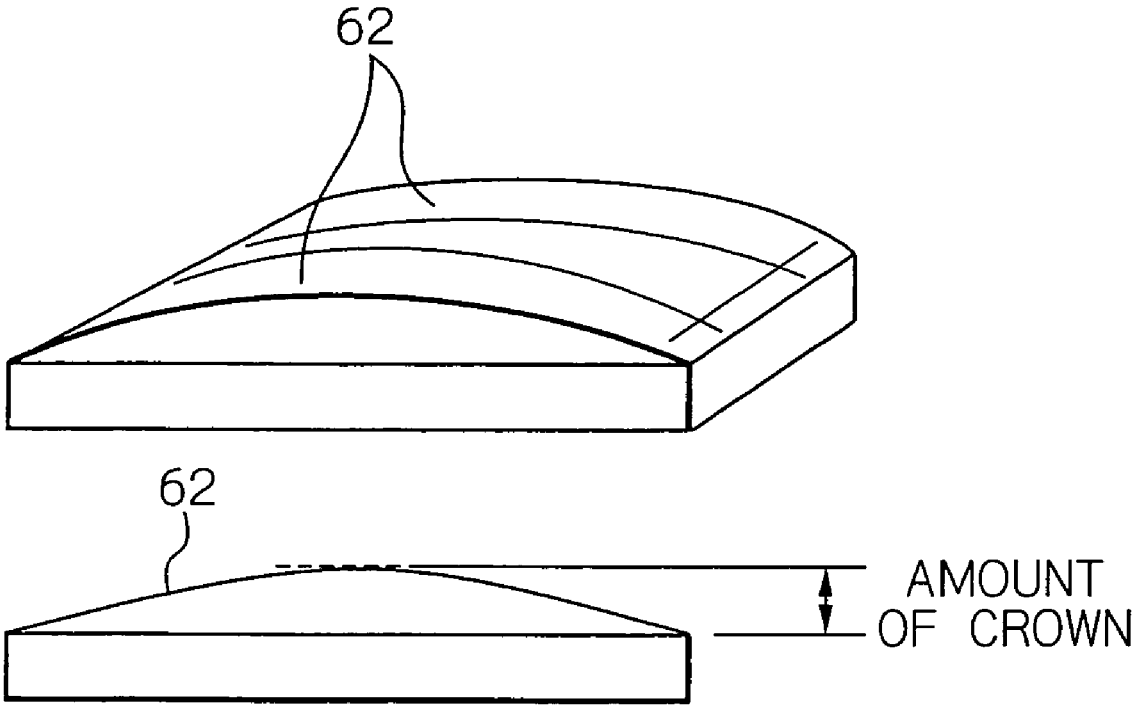
FIG. 6*b* illustrates the amount of crown to be measured.

In accordance with the above-mentioned lapping process, the bars were lapped, and the rails are formed on the each bar, and the output and asymmetry characteristic of giant magneto resistance (GMR) head elements were then measured by QST. Also the amount of recess and the amount of crown were measured as a profile by the surface profiler. For comparison, the same measurement was performed for the bars, which were lapped using the lapping apparatus according to the prior art. Hereupon, amount of recess means a distance between the ABS 61 of the magnetic head slider and magnetic head element 60 as shown in FIG. 6*a*, and amount of crown means amplitude of a bend of ABS of the magnetic head slider 62 as shown in FIG. 6*b*.

Table 1 shows the playback output characteristic, asymmetry characteristic and yield rate of the QST for the samples made by the lapping method according to the embodiment shown in FIG. 2 as well as the prior art.

The number of lots used was 10, whereby each lot had 100 samples. The conditions for QST are, sense current for GMR reading head is 3.0 mA, and writing current for inductive recording head element is the value when 60 mV0*p* voltage is applied to each writing head element, frequency of the writing current is 80 MHz, frequency of the applied magnetic field is 1.0 kHz with 10 us applied time, and measurement was done when the amplitude of the applied magnetic field was 700 Oe. Asymmetry is calculated by (V1−V2)/(V1+V2)*100 (%), wherein V1 is the positive amplitude, and V2 is the negative amplitude of the playback output. Acceptance criterion for the QST are the playback output characteristic, which is equal or greater than 500 uVpp, and the asymmetry characteristic, which has equal or greater than −40% and equal or less than +40%.

TABLE 1

| | Playback output (uV) | | Asymmetry (%) | | |
|---|---|---|---|---|---|
| | Average | Standard deviation | Average | Standard deviation | Yield rate of QST |
| Embodiment in FIG. 2 | 865.8 | 377.1 | 1.5 | 24.5 | 80.3 |
| Prior art Comparison | 811.2 Increase by 6.7% | 400.0 Decrease by 5.7% | 2.5 Improved by 1.0% | 28.7 Decrease by 4.2% | 70.2 Improved by 10.1% |

As shown in the Table 1, the average playback output characteristic according to the embodiment shown in FIG. 2 increases by 6.7%, and the standard deviation of playback output decreases by 5.7%, so that means the variation is reduced, in comparison with the ones according to the prior art. For asymmetry, average value decreases by 1.0%, so that means the symmetry is improved, and standard deviation decreases by 4.2%, so that means the variation is reduced. As a result, yield rate of QST increases by about 10%.

Figure 7A:
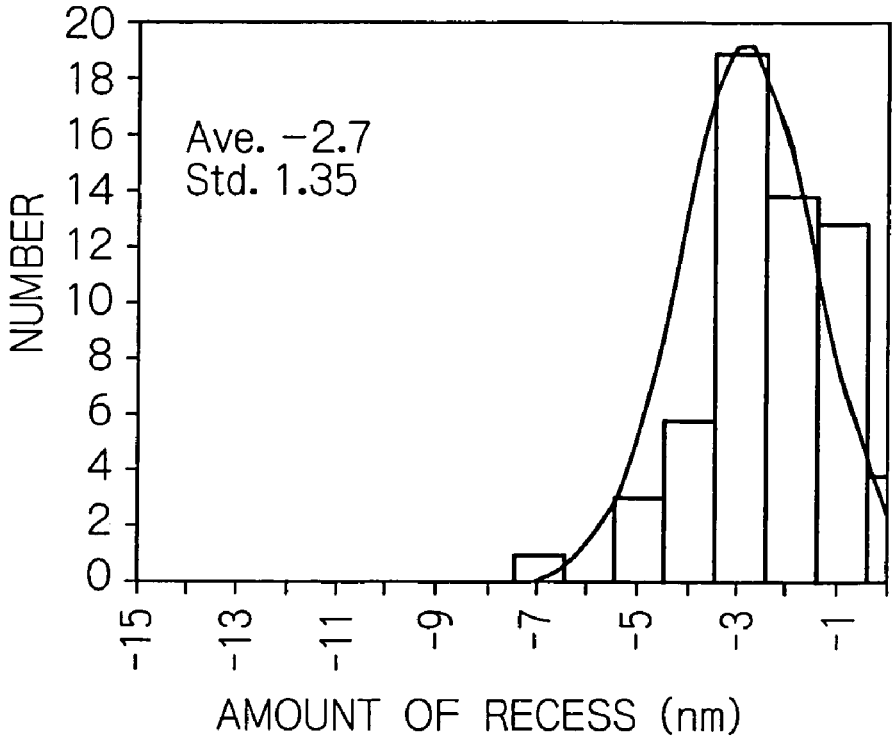
FIG. 7*a* shows the average amount of recess of samples, which are made by the lapping method according to the present invention, and are measured by the surface profiler.
Figure 7B:
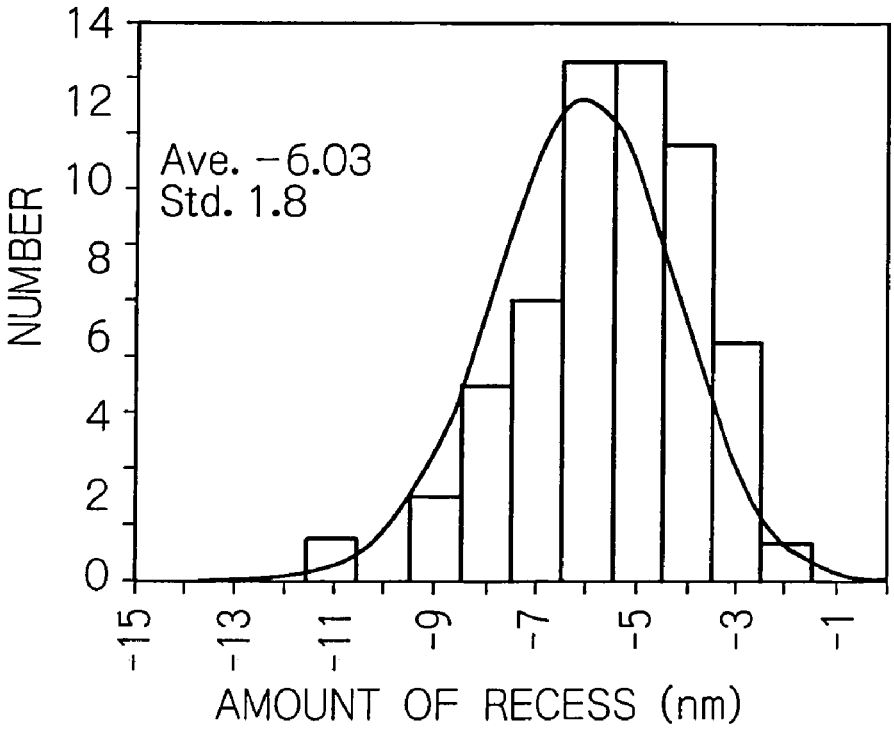
Fig. 7b PRIOR ART
FIG. 7*b* shows the average amount of recess of samples, which are made by the lapping method according to the prior art, and are measured by the surface profiler.

FIG. 7*a* shows the average amount of recess of samples, which are made by the lapping method according to the embodiment shown in FIG. 2, and measured by the surface profiler, and FIG. 7*b* shows the ones according to the prior art.

In these figures, the horizontal axis shows the amount of recess, and the vertical axis shows the values corresponding to the amount of recess. The number of samples is 100. According to the embodiment shown in FIG. 2, average is −2.7 nm, and standard deviation is 1.35 nm, however, according to the prior art, average is −6.03 nm, and standard deviation is 1.8 nm. Thus the recess can be formed with high accuracy, and less variation by use of the method according to the embodiment shown in FIG. 2 occurs.

Figure 8A:
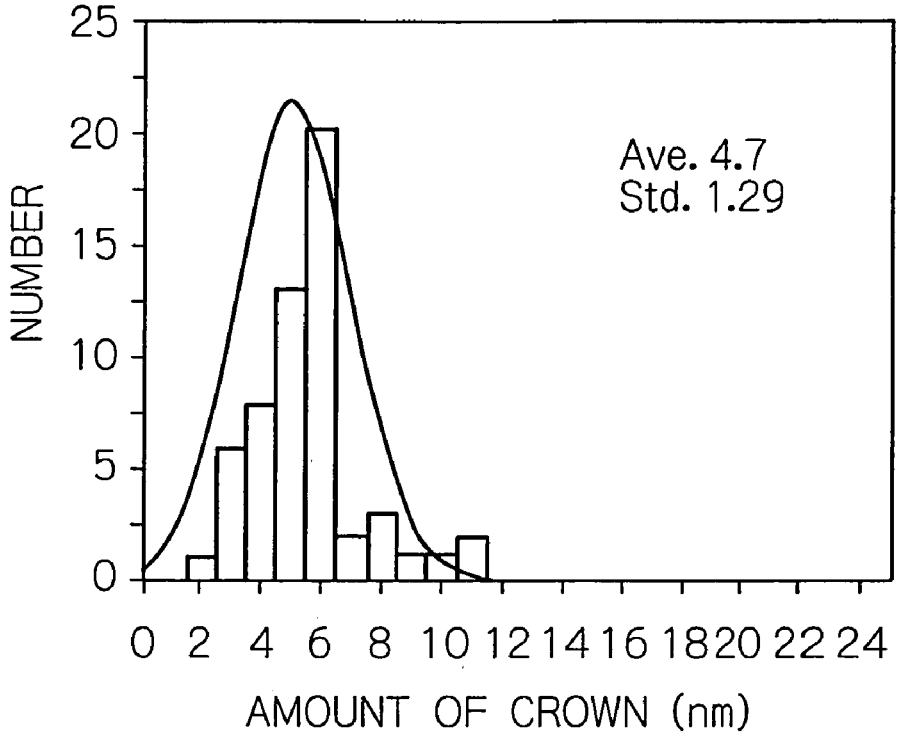
FIG. 8*a* shows the average amount of crown of samples, which are made by the lapping method according to the present invention, and are measured by the surface profiler.
Figure 8B:
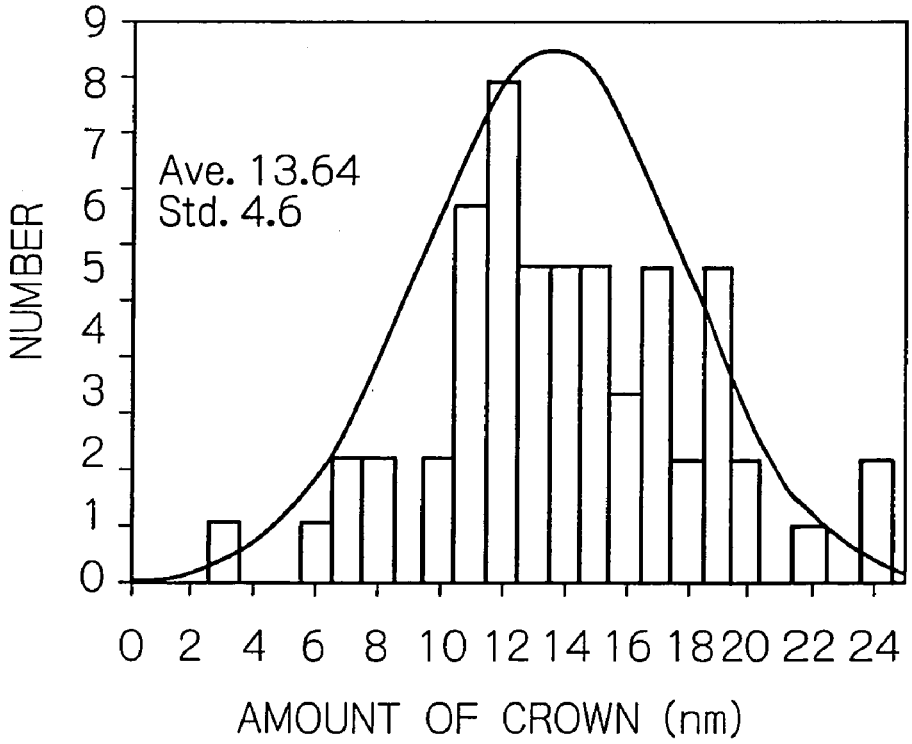
Fig. 8b PRIOR ART
FIG. 8*b* shows the average amount of crown of samples, which are made by the lapping method according to the prior art, and are measured by the surface profiler.

FIG. 8*a* shows the average amount of crown of samples, which are made by the lapping method according to the embodiment shown in FIG. 2, and measured by the surface profiler, and FIG. 8*b* shows the ones according to the prior art.

In these figures, the horizontal axis shows the amount of crown, and vertical axis shows the values corresponding to the amount of crown. The number of samples is 100. According to the embodiment shown in FIG. 2, the average amount of crown is 4.7 nm, and standard deviation is 1.29 nm, however, according to the prior art, the average is 13.64 nm, and standard deviation is 4.6 nm. Thus, the crown can be formed with high accuracy and less variation by use of the method according to the embodiment shown in F*ig*. 2.

Figure 9:
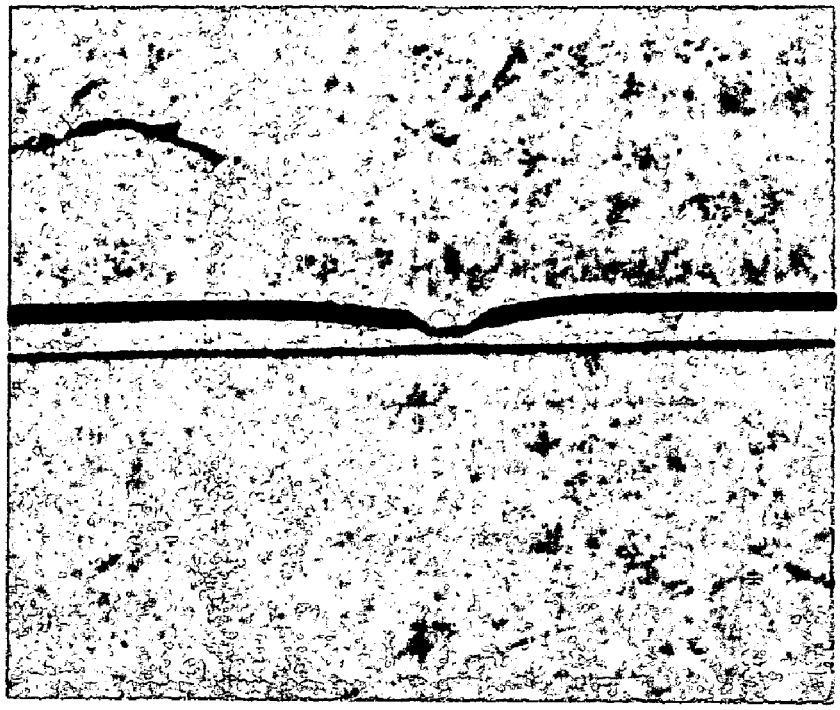
FIG. 9 is a SEM picture of the lapped surface of the thin film magnetic head made by the lapping method according to the present invention.
Figure 10:
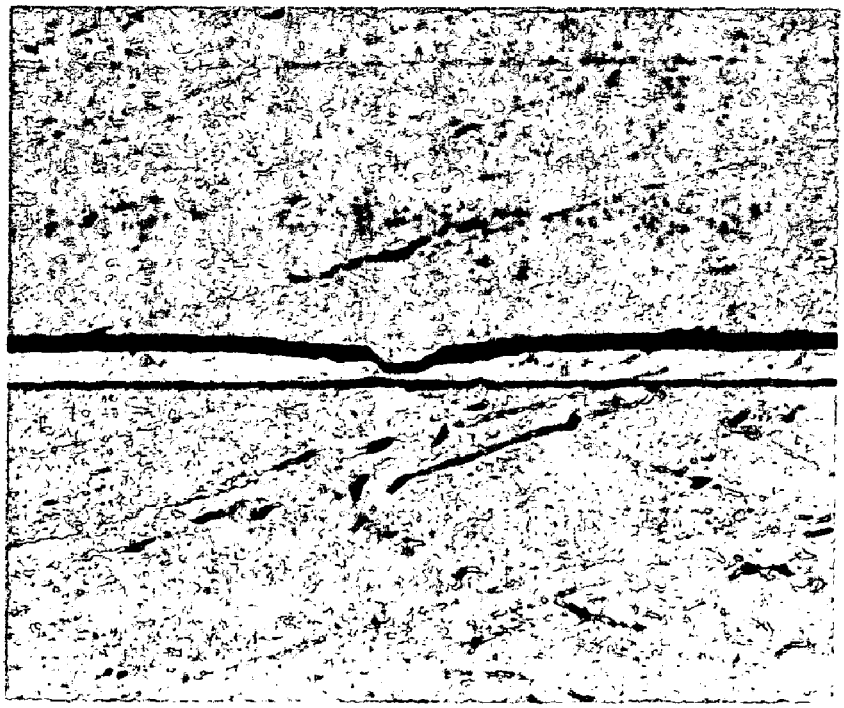
Fig. 10 PRIOR ART
FIG. 10 a SEM picture of the lapped surface of the thin film magnetic head made by the lapping method according to the prior art.

FIG. 9 is a SEM picture (×40,000) of the lapped surface of the thin film magnetic head made by the lapping method according to the embodiment shown in FIG. 2, and FIG. 10 is the one according to the prior art.

The surface of the head shown in FIG. 10 has many scratches or abrasions, but one shown in FIG. 9 has less ones.

As described above, according to the embodiment shown in FIG. 2, providing the dummy bar decreases the load to the bar to be lapped, so that it reduces the strain of the head element, whereby the strain is caused by the stress after the lapping, therefore, the average playback output increases, and variation of the playback output is reduced. Moreover, the average asymmetry can be close to the desired value, and the variation of asymmetry is reduced. As a result, the QST yield rate is improved. Furthermore, the variation between profiles of each magnetic head slider is also improved, and the occurring on the surface of the lapping plate and the magnetic head during the lapping process, such as the scratches or abrasions, can be reduced substantially.

Figure 11:
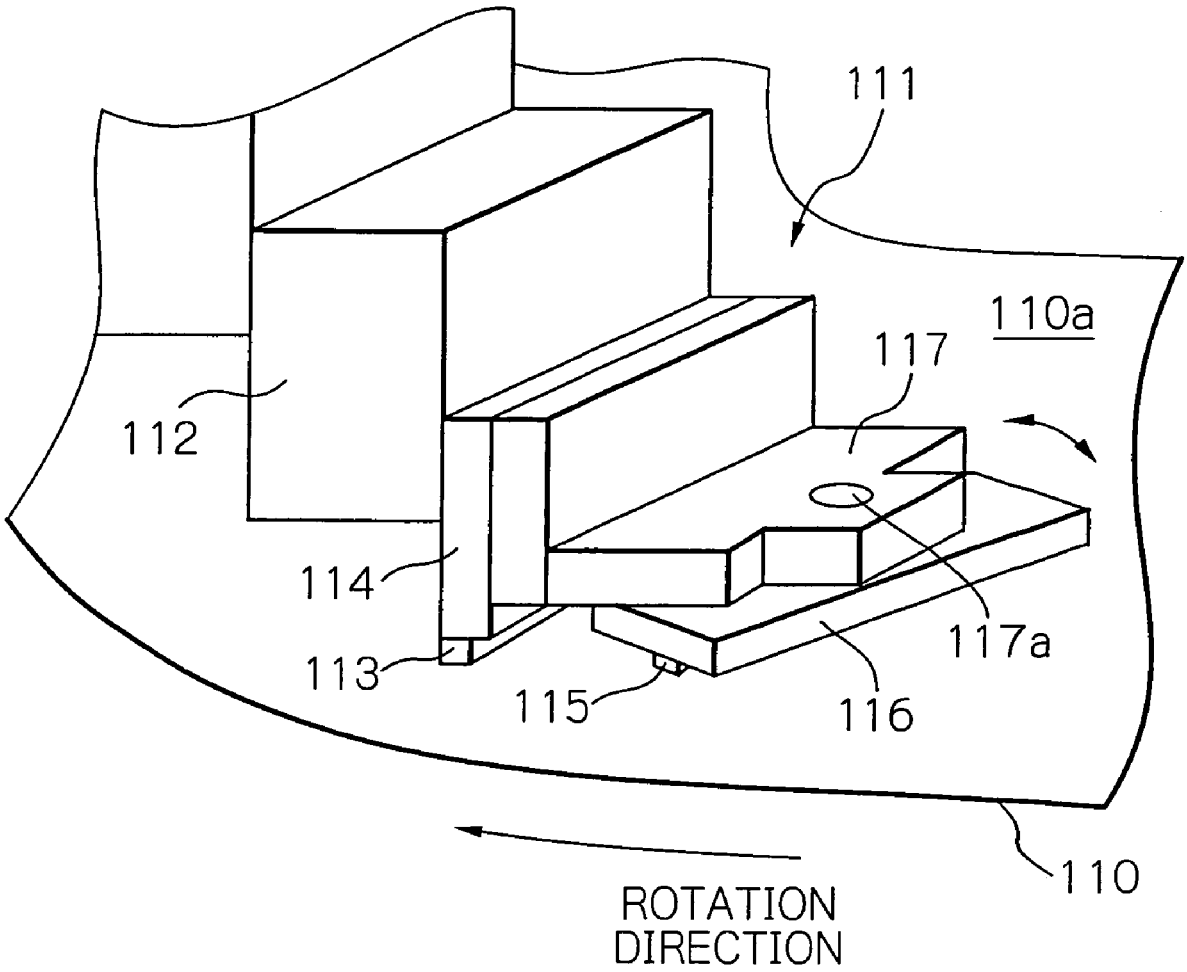
FIG. 11 is an enlarged perspective view of the lapping apparatus showing the holding jig block according to another embodiment of the present invention.

FIG. 11 is an enlarged perspective view of the lapping apparatus showing the holding jig block or assembly according to another embodiment of the present invention.

In FIG. 11, reference 110 is a lapping plate, which rotates in the direction indicated by the arrow, and reference 111 is a holding jig block, whereby a holding jig in the holding jig block 111 holds the bar to be lapped, and reference 112 is a transfer tool, which supports the holding jig in the holding jig block 111, and provides the signal line to transmit the signal from a lapping amount sensor to controller of the lapping apparatus.

The holding jig block 111 mainly includes a rectangular column shaped jig 114 (a first jig), which holds a bar 113 to be lapped, and a dummy bar jig 116 (a second jig), which holds a dummy bar 115, and a lapping keeper 117, which supports the dummy bar jig 116 so as to be rotatable at one end, and fixed to the rectangular column shaped jig 114 at the other end. The dummy bar 115 is preferably made of the same material as the bar 113, such as AlTiC ($Al_2O_3$—TiC).

The bar 113 has a plurality of thin film magnetic heads, which are arranged in one line or several lines, and is obtained by cutting the wafer, on which a plurality of thin film magnetic heads are formed. The same as with the embodiment shown in FIG. 2, MR film 40, 41 and 2 (See FIG. 4) of the thin film magnetic head are formed on the side of ABS (surface to be lapped) of the bar 113, and arranged in line, and RLG sensors are respectively formed between the MR films. MR height is calculated based on the value of resistance of the RLG sensor 43 and 44, whereby the value of resistance changes dynamically during the lapping, and lapping operation is controlled based on it.

In the embodiment, the dummy bar jig 116 is placed in front of the rectangular column shaped jig 114 in accordance with the rotation direction, so that the dummy bar 115 is placed in front of the bar 113.

The lapping is performed by pressing the surface to be lapped of the bar 113 against a lapping surface 110*a* of the lapping plate 110, which is rotating. In this case, both the bar 113 and the dummy bar 115 are pressed against the lapping plate 110, so that the load during the lapping, for example a machine load, drag from the lapping plate and frictional force with the lapping plate, is not concentrated only to the bar 113, but also is dispersed to two points. Therefore, output and asymmetry characteristic of the magnetic head slider are improved, and thus does not lead to scratches onto the surface of the lapping plate and the slider, furthermore, it reduces the variation of the profile, and reduces the deviation of the amount of recess. As a result, the yield rate is significantly improved in the manufacturing process of the magnetic head sliders and HGA.

More especially, the frictional force applied to the bar 113 is reduced significantly in the embodiment, because the dummy bar jig 116 is attached to the lapping keeper 117 as rotatable around a rotation axis 117*a*. Therefore, the load to the bar 113 is also reduced.

The lapping process of the bar is the same as the embodiment shown in FIG. 2.

After the lapping process, the rails are formed on the ABS of bar 113 (not show in FIG. 11), the bar 113 is cut into a plurality of head elements in a single magnetic head slider. Finally, the magnetic head slider is attached to a suspension member to complete the HGA.

In accordance with the above-mentioned lapping process, the bars were lapped, and the rails were formed on the each bar, and then playback output and asymmetry characteristic of the GMR head element were measured by QST. For comparison, the same measurement was performed for the bars made by use of the lapping apparatus according to the prior art.

Table 2 shows the playback output characteristic, asymmetry characteristic and yield rate of the QST for the samples made by the lapping method according to the embodiment shown in FIG. 11, shown in FIG. 2 and the prior art.

The number of lots used was 10, whereby each lot had 100 samples. The conditions for QST are, sense current for GMR reading head is 3.0 mA, and writing current for inductive recording head element is the value when 60 mV0*p* voltage is applied to each writing head element, frequency of the writing current is 80 MHz, frequency of the applied magnetic field is 1.0 kHz with 10 us applied time, and measurement was done when the amplitude of the applied magnetic field was 700 e. Asymmetry is calculated by (V1−V2)/(V1+V2)*100 (%), wherein Vi is the positive amplitude, and V2 is the negative amplitude of the playback output. Acceptance criterion for the QST is playback output characteristic, which has a value equal to or greater than 500 uVpp, and asymmetry characteristic, which has equal to or greater than −40% and equal to or less than +40%.

TABLE 2

| | Playback output (uV) | | Asymmetry (%) | | |
|---|---|---|---|---|---|
| | Average | Standard deviation | Average | Standard deviation | Yield rate of QST |
| Embodiment in FIG. 2 | 865.8 | 377.1 | 1.5 | 24.5 | 80.3 |
| Embodiment in FIG. 11 | 870 | 375.8 | 1.6 | 23.7 | 80.7 |
| Prior art | 811.2 | 400.0 | 2.5 | 28.7 | 70.2 |
| Comparison the embodment in FIG. 11 with the prior art | Increase by 7.2% | Decrease by 6.1% | Improved by 0.9% | Decrease by 5.0% | Improved by 10.5% |

As shown in the Table 2, average playback output characteristic according to the embodiment shown in FIG. 11 increases by 7.2%, and standard deviation of playback output decreases by 6.1%, in comparison with the ones according to the prior art, so that means the variation is reduced. In comparison with ones according to the embodiment shown in FIG. 2 (dummy bar is fixed), playback output increases by 4.2 uV, and standard deviation decreases by 1.3 uV, so that the variation is reduced. For asymmetry, In comparison with the ones according to the prior art, average value decreases by 0.9%, such that the symmetry is improved, and the standard deviation decreases by 5.0%, so that the variation is reduced. In comparison with the ones according to the embodiment shown in FIG. 2, average value is almost the same, but standard deviation decreases by 0.8%, so that means the variation is reduced. As a result yield rate of QST increases by about 10.5% in comparison with the one according to the prior art, and by 0.4% in comparison with the one according to the embodiment shown in FIG. 2.

As described above, according to the embodiment shown in FIG. 11, providing the dummy bar, which can rotate, leads to a decrease of the frictional force to the bar, therefore the loads to the bar to be lapped is also further reduced, and it effectively reduces the strain of the head element, whereby the strain is caused by the stress after the lapping, so that the average playback output increases, and variation of the playback output decreases. Moreover, the average asymmetry can be closed to the desired value, and variation of asymmetry decreases. As a result, QST yield rate is improved. Furthermore, the variation between profiles of each magnetic head slider is also improved, and defects occurring on the surface of the lapping plate and the magnetic head during the lapping process, such as scratches or abrasions, can be reduced substantially.

Figure 12:
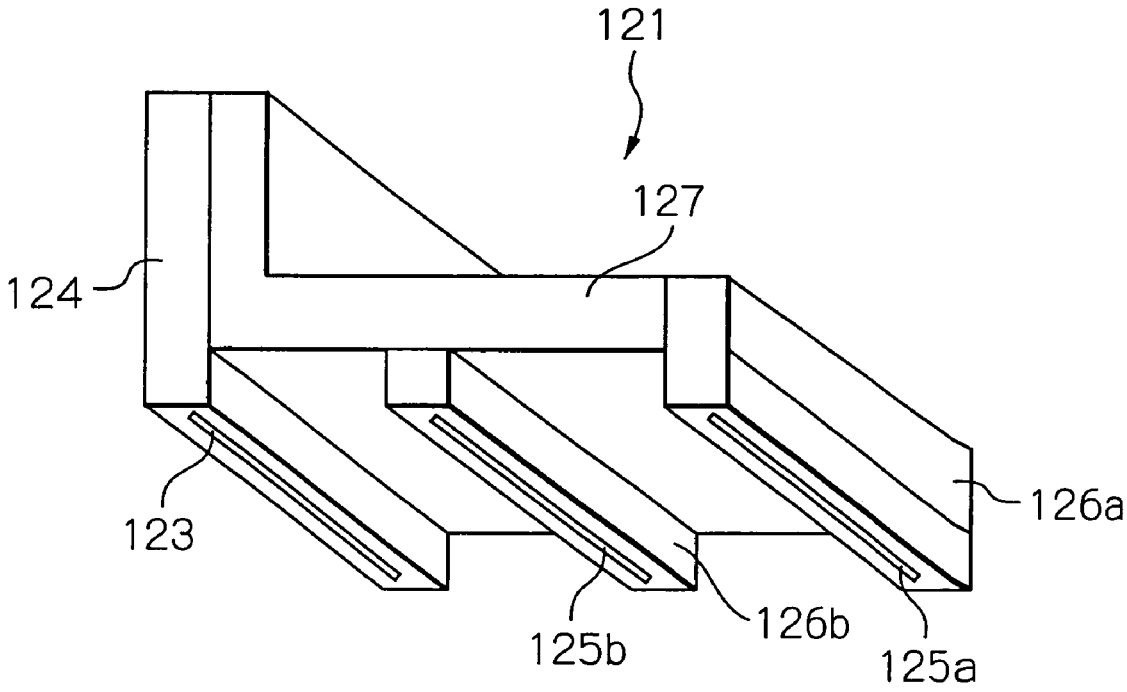
FIG. 12 is an enlarged perspective view showing the holding jig block only according to further embodiment of the present invention.

FIG. 12 is an enlarged perspective view showing the holding jig block only according to further embodiment of the present invention.

In the FIG. 12, reference 121 is a holding jig block, whereby a holding jig in the holding jig block 121 holds the bar to be lapped. The holding jig block 121 mainly includes a rectangular column shaped jig 124 (a first jig), which holds a bar 123 to be lapped, and a first dummy bar jig 126*a* (a second jig), which holds a first dummy bar 125*a*, and a second dummy bar jig 126*b* (a second jig), which holds a second dummy bar 125*b*, and a lapping keeper 127, which is fixed to the dummy bar jig 125*a* at one end to support it, and fixed to the rectangular column shaped jig 124 at other end, and is fixed to the dummy bar jig 125*b* at the middle to support it. The first dummy bar 125*a* and second dummy bar 125*b* are favorably made of the same material as the bar 123, such as AlTiC ($Al_2O_3$—TiC).

The bar 123 has a plurality of thin film magnetic heads, which are arranged in one line or several lines, and it is obtained by cutting the wafer, on which a plural of thin film magnetic heads are formed. As with the embodiment shown in FIG. 2, MR films 40, 41 and 42 (See FIG. 4), which are arranged in line, of the thin film magnetic heads, are formed on the side of ABS (surface to be lapped) of the bar 123, and the RLG sensors are respectively formed between the MR films. MR height is calculated based on the value of resistance of the RLG sensor 43 and 44, whereby the value of resistance changes dynamically during the lapping, and lapping operation is controlled.

In the embodiment, jigs are placed in the order of the dummy bar jig 126*a*, the dummy bar jig 126*b*, and the rectangular column shaped jig 124 on the basis of the rotation direction, so that means dummy bar 125*a* and 125*b* lie anterior to the bar 123.

The lapping is performed by pressing the surface to be lapped of the bar 123 to a lapping surface of the rotating lapping plate. In this case, the bar 123, dummy bar 125*a* and 125*b* are pressed together to the lapping plate, so that the load during the lapping, for example machine load, drag from the lapping plate and frictional force with the lapping plate, is not concentrated to the bar 123, but distributed to three points. Therefore, output and asymmetry characteristic of the magnetic head slider are improved, and it does not lead to the defect on the surface, such as scratches, of the lapping plate and slider, moreover, such reduces the variation between profiles, and reduces the variation between amount of recess of each magnetic head slider. As a result, the yield rate is significantly improved in the manufacturing process of the magnetic head sliders and HGA.

More particularly, the load applied to the bar 123 is further reduced in this embodiment, because the two dummy bars are provided.

The lapping process of the bar is the same as explained in the embodiment shown in FIG. 2.

After the lapping process, rails are formed on the ABS of the bar 123 (Not show in FIG. 12), and then cut the bar 123 into a plurality of single magnetic head slider. Finally, the magnetic head slider is mounted on a suspension to complete the HGA.

As described above, according to the embodiment shown in FIG. 12, By providing the two dummy bars, the loads to the bar to be lapped are further reduced, so that it effectively reduces the distortion of the head element, whereby the distortion is caused by the stress after the lapping, so that the average playback output increases, and variation of the playback output decreases. Moreover, the average asymmetry can be closed to the desired value, and variation of asymmetry decreases. As a result, QST yield rate is improved. Furthermore, the distribution of the profile of the magnetic head slider is also improved, and the defect occurring on the surface of the lapping plate and the magnetic head during the lapping process, such as the scratches or abrasions, can be reduced substantially.

Figure 13:
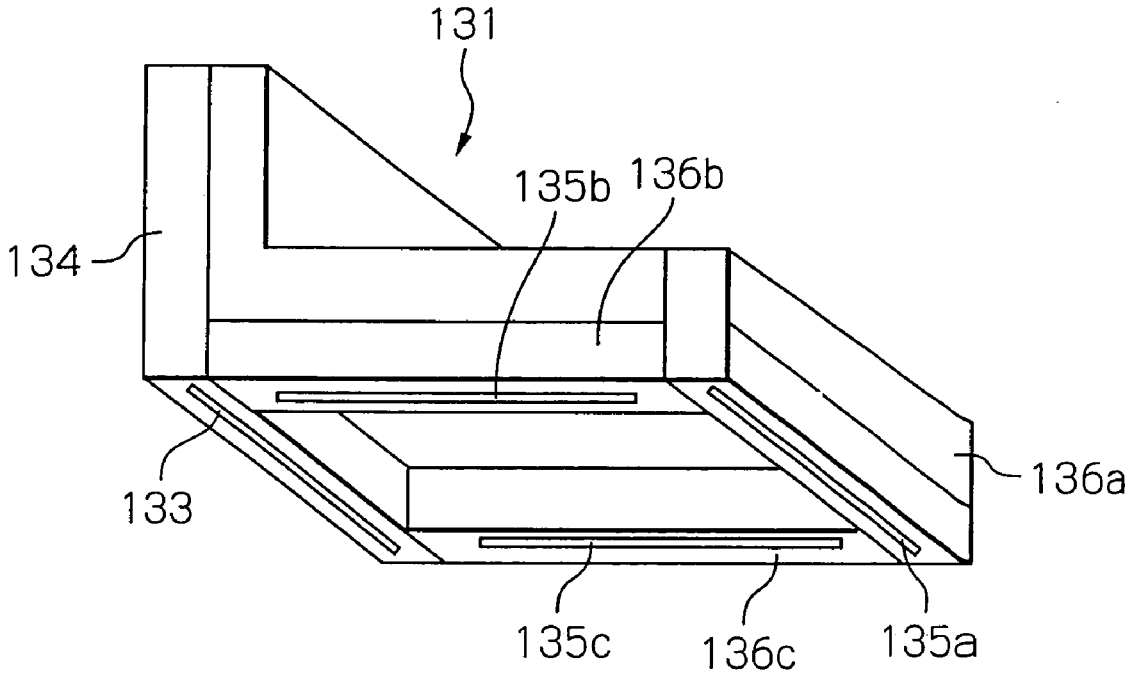
FIG. 13 is an enlarged perspective view showing the holding jig block only according to further embodiment of the present invention.

FIG. 13 is an enlarged perspective view showing the holding jig block only according to further embodiment of the present invention.

In the FIG. 13, reference 131 is a holding jig block, whereby a holding jig in the holding jig block 131 holds the bar to be lapped. The holding jig block 131 mainly includes a rectangular column shaped jig 134 (a first jig), which holds a bar 133 to be lapped, and a first dummy bar jig 136*a* (a second jig), which holds a first dummy bar 135*a*, and a second dummy bar jig 136*b* (a second jig), which holds a second dummy bar 135*b*, and a third dummy bar jig 136*c* (a second jig), which holds a third dummy bar 135*c*, and a lapping keeper 137, which is fixed to the dummy bar jig 135*a* at one end to support it, and fixed to the rectangular column shaped jig 134 at other end, and is fixed to the dummy bar jig 135*b* and 135*c* at the ends, which are vertical to the end of supporting the jig 135*a*, to support them. The first dummy bar 135*a*, second dummy bar 135*b* and the third dummy bar 135*c* are favorably made of the same material as the bar 133, such as AlTiC ($Al_2O_3$—TiC).

A plurality of thin film magnetic heads, which are arranged in one line or several lines, are formed in the bar 133, and the bar 113 is obtained by cutting the wafer, on which a plurality of thin film magnetic heads are formed. As with the embodiment shown in FIG. 2, the MR films 40, 41 and 42 (See FIG. 4) of the thin film magnetic head are formed on the side of ABS (surface to be lapped) of the bar 123 in a line, and RLG sensors are respectively formed between the MR films. MR height is calculated based on the value of resistance of the RLG sensor 43 and 44, whereby the value of resistance changes dynamically during the lapping, and lapping operation is controlled.

In the embodiment, the dummy bar jigs 136*a*, 136*b* and 136*c* are placed ahead of the rectangular column shaped jig 134 on the basis of the rotational direction, so that means dummy bar 135*a*, 135*b* and 135*c* are placed ahead of the bar 133.

The lapping is performed by pressing the surface to be lapped of the bar 133 to a lapping surface of the rotating lapping plate. In this case, the bar 133, dummy bar 135*a*, 135*b* and 135*c* are pressed together to the lapping plate, so that the load during the lapping, for example machine load, drag from the lapping plate and frictional force with the lapping plate, is not concentrated only to the bar 133, but distributed to four points. Therefore, output and asymmetry characteristic of the magnetic head slider are improved, and such does not lead to defects occurring on the surface of the lapping plate and slider, such as scratches, and such reduces the variation between profiles, and such reduces the variation between amount of recess of each magnetic head slider. As a result, the yield rate is significantly improved in the manufacturing process of the magnetic head sliders and HGA.

More particularly, the load applied to the bar 133 is further reduced in this embodiment, because three dummy bars are provided.

The lapping process of the bar is the same as the embodiment shown in FIG. 2.

After the lapping process, rails are formed on the ABS of the bar 133 (Not show in FIG. 13), and cut the bar 133 into a plurality of bars for single magnetic head slider. Finally, the magnetic head slider is attached to a suspension to complete the HGA.

As described above, according to the embodiment shown in FIG. 13, By providing the three dummy bars, the loads to the bar to be lapped is further reduced, and such effectively reduces the strain of the head element, whereby the strain is caused by the stress after the lapping, so that the average playback output increases, and variation of the playback output is reduced. Moreover, the average asymmetry can be closed to the desired value, and variation of asymmetry decreases. As a result, the QST yield rate is improved. Furthermore, the variation between profiles of each magnetic head slider is also improved, and scratches or abrasions on the lapping plate and surface of the magnetic head can be reduced substantially.

It is clear that the number of the dummy bars can be more than four, and the shape of each jig and/or configuration or assembly of the jig block is not limited to above-mentioned embodiment.

Many widely different embodiments of the present invention may be constructed without departing from the spirit and scope of the present invention. It should be understood that the present invention is not limited to the specific embodiments described in the specification, except as defined in the appended claims.

The invention claimed is:

1. An apparatus for lapping thin film magnetic heads comprising:

a jig block having a first jig and at least one second jig, the first jig holding a bar having a plurality of thin film magnetic heads in lines, and the second jig holding a member for load sharing, a lapping keeper interconnecting said first and second jigs such that said first and second jigs are positioned at opposite ends of said lapping keeper; and a lapping plate being movable relative to the first jig and the second jig, and being contactable with a surface to be lapped of the bar held by the first jig and the member for load sharing held by the second jig for lapping, wherein the second jig and said lapping keeper lie anterior to the first jig with respect to a direction of movement of the lapping plate.

2. The apparatus for lapping thin film magnetic heads according to claim 1, wherein the second jig is attached to the jig block at a fixed angle relative to a direction of movement of the lapping plate.

3. The apparatus for lapping thin film magnetic heads according to claim 1, wherein the second jig is attached to the jig block with a variable angle relative to a direction of movement of the lapping plate.

4. The apparatus for lapping thin film magnetic heads according to claim 1, wherein the member for load sharing is a dummy bar.

5. The apparatus for lapping thin film magnetic heads according to claim 1, wherein the bar includes a sensor configured for generating a signal which depends on the amount of lapping occurring, whereby the lapping operation for the bar is controlled by the signal from the sensor.

* * * * *